United States Patent [19]

Stubbings

[11] 4,184,357

[45] Jan. 22, 1980

[54] FASTENING WITH TWO-PIECE FASTENERS

[75] Inventor: James H. Stubbings, Rockville, Md.

[73] Assignee: Potomac Applied Mechanics, Inc., Bethesda, Md.

[21] Appl. No.: 873,969

[22] Filed: Jan. 31, 1978

[51] Int. Cl.[2] ..... B21J 15/34

[52] U.S. Cl. ..... 72/391; 72/453.17; 85/84; 173/103

[58] Field of Search ..... 72/391, 453.08, 453.17; 29/243.53, 243.54, 522, 509; 85/81, 83, 84; 173/103; 92/65; 227/147

[56] References Cited

U.S. PATENT DOCUMENTS

| | | | |
|---|---|---|---|
| 3,032,771 | 5/1962 | Bisbing | 72/391 |
| 3,042,244 | 7/1962 | Van Hecke | 72/391 |
| 3,487,745 | 1/1970 | Brunelle | 29/522 |
| 3,724,738 | 4/1973 | Hurst | 29/522 |
| 4,036,309 | 7/1977 | Petreev | 92/65 |

FOREIGN PATENT DOCUMENTS

| | | | |
|---|---|---|---|
| 2237889 | 2/1974 | Fed. Rep. of Germany | 29/243.53 |

*Primary Examiner*—Francis S. Husar
*Assistant Examiner*—Gene P. Crosby
*Attorney, Agent, or Firm*—Cushman, Darby & Cushman

[57] ABSTRACT

A powered impacting device including relativly movable concentric first and second pistons, the second piston providing a cylinder wall for guiding movement of the first piston. A spring is disposed between the pistons for exerting a biasing force maintaining the pistons in an initial relative position. A single impacting force is applied to the pistons, at first resulting in coincident movement thereof until the second piston drives an outer fastener component through workpieces to be fastened together, and then is stopped. The mass of the first piston is great enough to provide continued movement of the first piston, relative to the second piston against the bias of the spring, to drive an inner component of the fastener through the work to be assembled, deforming the outer component of the fastener so that the material pieces are held together.

20 Claims, 19 Drawing Figures

Fig. 1
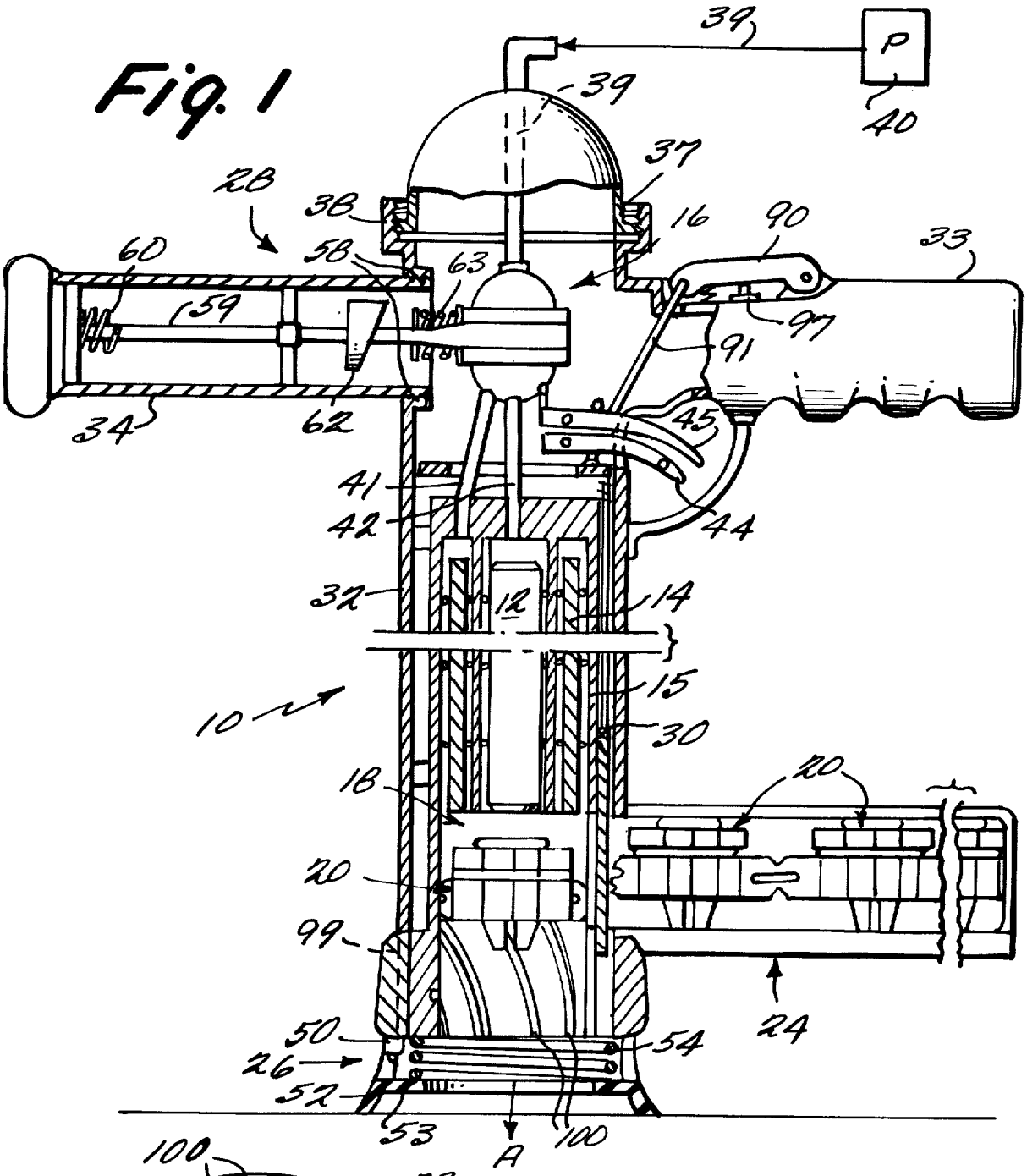
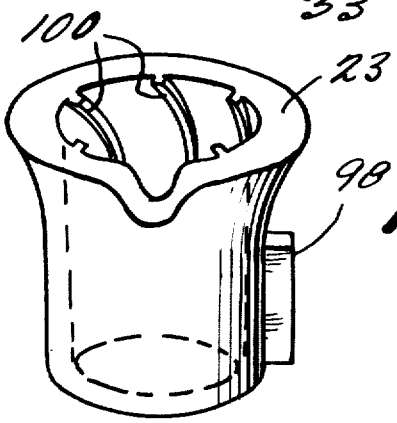
Fig. 9

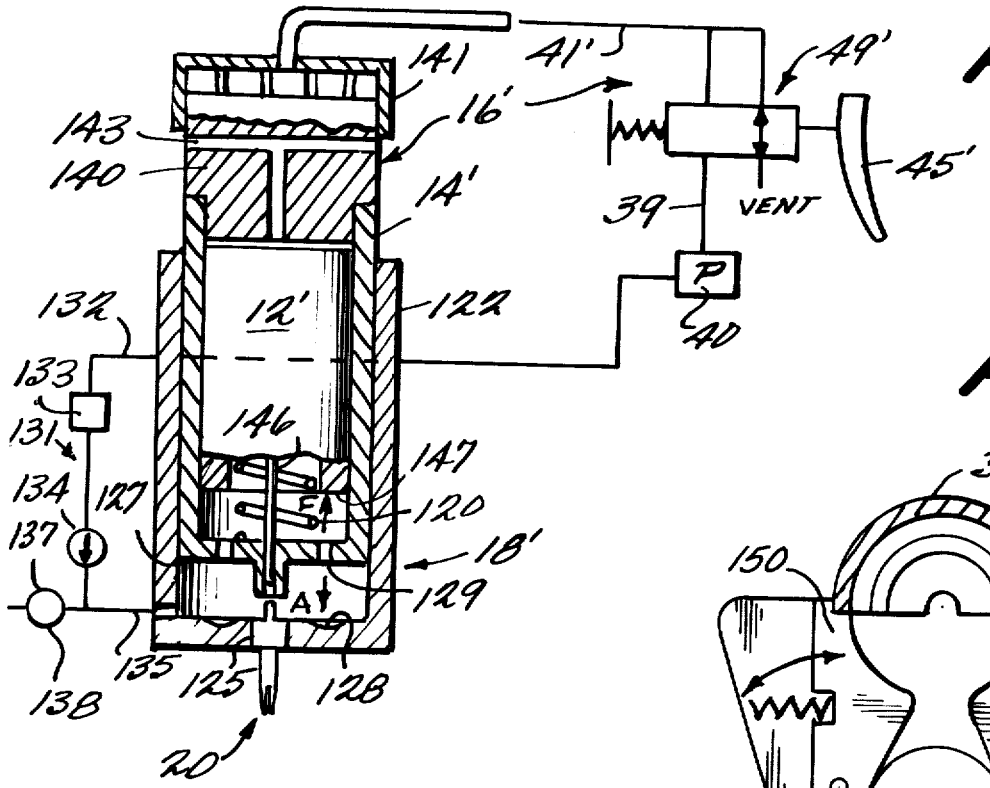
Fig. 10a
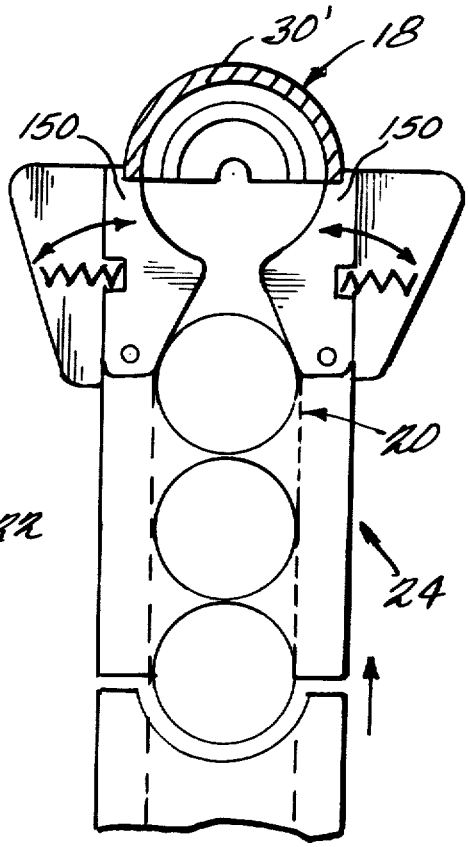
Fig. 11
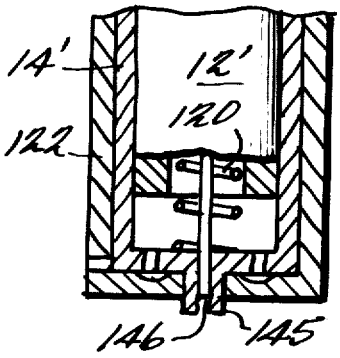
Fig. 10b
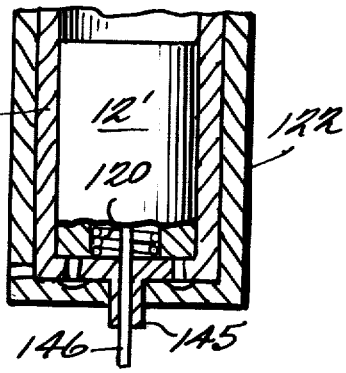
Fig. 10c
Fig. 12a
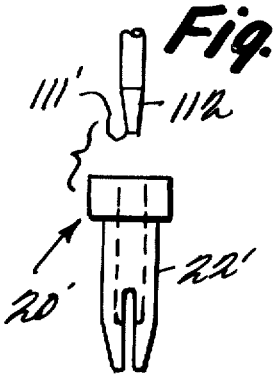
Fig. 12b
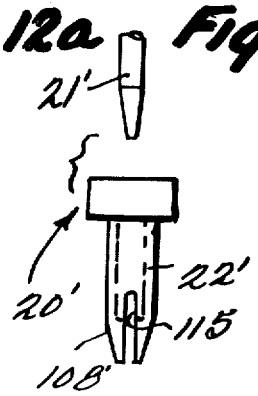
Fig. 12c
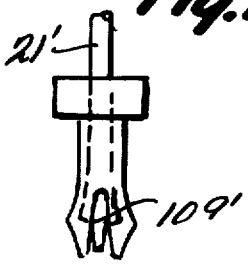
Fig. 12d
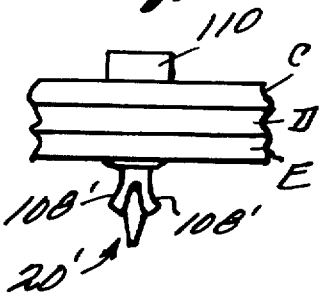

FASTENING WITH TWO-PIECE FASTENERS

CROSS-REFERENCE TO RELATED APPLICATION

This application is a continuation-in-part of my application Ser. No. 833,338, filed Sept. 14, 1977.

BACKGROUND AND SUMMARY OF THE INVENTION

In the past there have been various proposals for blind fasteners including separately drivable inner and outer fastener components, such as shown in U.S. Pat. Nos. 1,587,317 and 3,691,924. While such fasteners can be very effective in holding two or more workpieces together, the usefulness of such fasteners is sometimes limited since it is not usually possible to provide for powered driving of the fasteners into place since two separate impacting forces must be applied to the separate fastener components. Where a powered driving means is utilized, first the outer component is driven through the workpieces, the tool removed, and then the inner component driven through the outer component to deform it into locking engagement with the workpieces, holding them together. Also, such fasteners can be difficult to construct, and relatively expensive, and are difficult to use with a wide variety of materials and numbers of sheets to be fastened together.

According to the present invention, a powered impacting device is provided that provides power driving of both the inner and outer fastener components of two piece blind fasteners without the necessity of first driving the outer component, then inserting the inner component, and then driving the inner component. Also, according to the present invention, particular two-piece fasteners and an assembly thereof are provided that result in excellent fastening of a wide variety of materials together, are inexpensive to manufacture, allow for automatic feeding thereof to the impacting device, and which may be made capable of imparting a rotational component to the fasteners during firing to ensure that the fasteners are driven in a true manner through the workpieces.

According to the powered impacting device of the present invention, a first, inner driving piston, and a second outer, driving piston—concentric with the first piston—are provided. Means may be provided for supplying actuating pressurized fluid to the second piston and then to the first piston to effect axial movement of each, in the same direction, and means are provided for receipt of a two-piece fastener—having concentric inner and outer components—in operative relationship with the pistons so that the outer component is driven by the second piston, and the inner component is driven by the first piston. The fastener receipt means includes a firing barrel, and a magazine or the like is provided for automatically feeding fasteners into the firing barrel for automatic firing thereof. The barrel may be rifled, and each fastener then includes at least one frangible plastic link associated therewith for engaging the barrel riflings to impart rotational movement to the fastener while it is being driven, but the plastic links disintegrate fully upon impaction of the fastener on a surface. A loading gate is provided for separating connectedautomatically fed fasteners from each other, and for sealing off the firing barrel from the magazine during driving of the fasteners.

So that only one valve need be provided for supplying fluid to the pistons, the second piston may be formed so that it provides a cylinder wall for guiding movement of the first piston, with biasing means disposed between the pistons for biasing the first piston to a particular relative axial position with respect to the second piston. Upon application of an impacting force to the pistons by a third piston, the first and second pistons will be driven together until the second piston drives the outer fastener component through the work and is stopped. The first piston is massive enough so that upon termination of the movement of the second piston, the first piston will continue movement, relative to the second piston, against the bias of the biasing means with sufficient force to drive the inner component of the fastener into the desired position with respect to the work. The means for receipt of the two piece fastener includes a cylinder for guiding movement of the second piston with an opening therein for receipt of the fastener.

Various safety mechanisms are provided including means for preventing a supply of actuating pressurized fluid to either of the pistons unless the end of the impacting device out of which the fasteners are fired is in contact with the surface, unless a safety handle is positively rotated against spring pressure, and unless the loading gate (where one is used) is in closed position.

According to the invention, each fastener outer component comprises a generally tubular member having at least two grooves extending along the body so that two distinct tip portions are provided, forming a penetrating point thereof, and cam engaging interior portions. The grooves extend a sufficient distance along the body of the outer member so that the outer component will penetrate the desired thickness of material to be fastened together without splitting, but so the tip portions may be moved radially outwardly by the inner component a sufficient distance to effect fastening of the material together. The outer component also includes a head portion at the opposite end thereof as the tip. Each inner component comprises a cylindrical member having a pointed tip portion, and cam surface means for engaging the cam engaging interior portions of a cooperating outer component for camming the distinct tip portions of the outer component radially outwardly into fastening engagement with the workpieces. An assembly of two-piece fasteners may be provided, which fasteners are operatively connected together for automatic feeding thereof by frangible connector means. At least one frangible plastic link also may be associated with each fastener for engaging bore riflings in a firing barrel for the fasteners to thereby impart rotation to at least one component of each fastener during firing.

It is the primary object of the present invention to provide a system for the ready fastening of a least two workpieces together with practiced, inexpensive two-piece fasteners. This and other objects of the invention will become clear from an inspection of the detailed description of the invention, and from the appended claims.

BRIEF DESCRIPTION OF THE DRAWINGS

FIG. 1 is a schematic view, partly in cross-section and partly in elevation, showing an exemplary powered impacting device;

FIG. 9 is a perspective view of an exemplary replaceable firing barrel utilizable with the device of FIG. 1;

FIG. 10A is a diagrammatic showing of component parts of a preferred embodiment of the powered impacting device according to the present invention, and FIGS. 10B and 10C are schematic showings of successive steps of the operation of the FIG. 10A piston assembly;

FIG. 11 is a diagrammatic, plan view showing another embodiment of the magazine, fastener receiving barrel structure according to the invention; and FIGS. 12A through 12D are schematic showings of modified fasteners according to the present invention, FIG. 12B being the same as FIG. 12A only showing the outer component rotated 90°, FIG. 12C showing the inner and outer components before impacting thereof, and FIG. 12D showing the components attaching several pieces of material together.

DETAILED DESCRIPTION OF THE INVENTION

Figure 2:
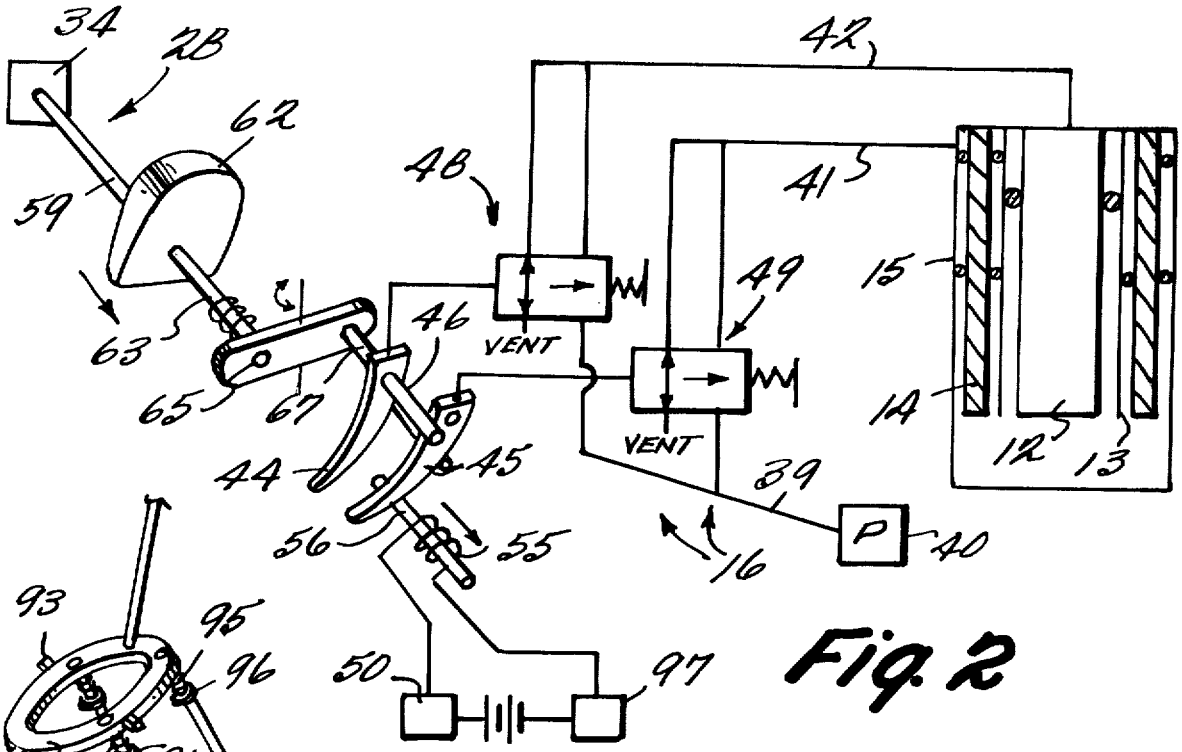
FIG. 2 is a diagrammatic showing of component parts of the impacting device of FIG. 1 for supplying pressurized actuating fluid to the device.

An exemplary powered impacting device is shown schematically at 10 in FIG. 1. The primary operative components of the device 10 include a first, inner driving piston 12 (shown in elevation in FIG. 1) reciprocal in an inner cylinder 13, and a second, outer driving piston 14 concentric with the first piston 12 and reciprocal in an outer cylinder 15 concentric with the inner cylinder 13. Means 16 (see FIG. 2 in particular) are provided for supplying actuating pressurized fluid to said pistons 12,14 so that the outer piston 14 is driven axially in direction A first, and then the inner piston 12 is driven in direction A with respect to piston 14, means 16 supplying fluid to the second piston 14 and then to the first piston 12 to effect axial movement of each in direction A. Means—shown generally at 18 in FIG. 1—are provided for receipt of a two-piece fastener 20 having concentric inner 21 and outer 22 (see FIGS. 5 and 8 in particular) components, in operative relationship with the pistons 12,14 so that the outer component 22 is driven by the second piston 14, and the inner component 21 is driven by the first piston 12.

Figure 3:
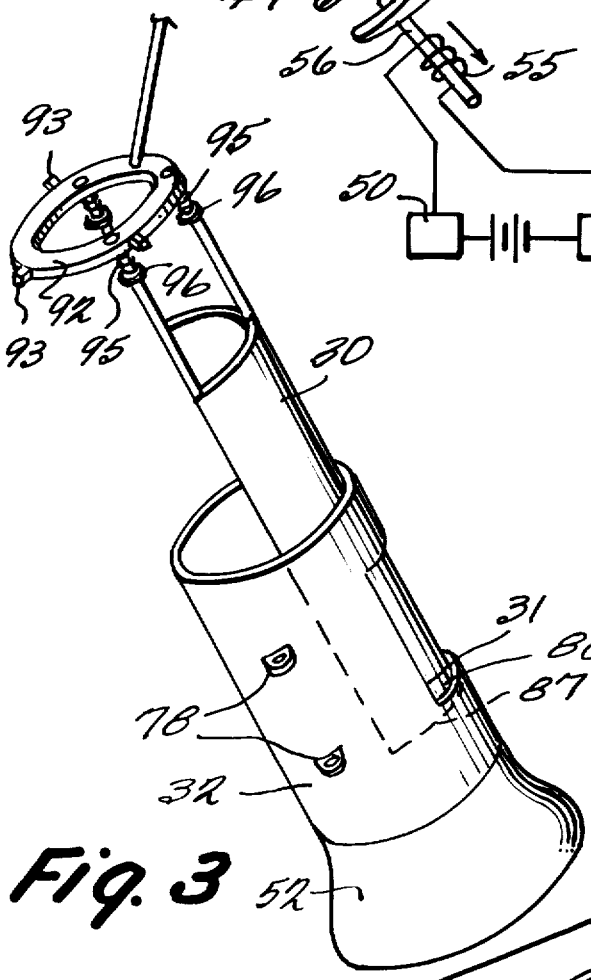
FIG. 3 is a schematic perspective view, with portions cut away, illustrating the front end of the device of FIG. 1 and showing a loading gate therefor in detail.

According to one embodiment, the fastener receipt means 18 includes a firing barrel 23, and means 24—such as a magazine as shown in the drawings—are provided for automatically feeding fasteners 20 into the firing barrel 23 for automatic firing thereof. Safety means 26 are provided for preventing supply of actuating pressurized fluid to either of the pistons unless the device is in contact with the surface into which the fasteners are to be driven, and a handle safety mechanism 28 is provided that requires positive manual operation thereof before actuating fluid can be supplied to either piston. A loading gate 30 is provided for selectively blocking or opening a passage 31 (see FIG. 3) allowing entry of fasteners from the automatic feeding means 24 to the barrel 23.

The device 10 preferably includes a body portion 32 and first and second handles 33,34 for gripping by the operator of the device 10 during utilization thereof. The body portion 34 supports the inner and outer cylinders 13,15, the inner cylinder 15 (as by spider arms received by slots in the outer piston 14). Any suitable arrangement of concentric inner and outer pistons capable of driving two-piece fasteners may be provided. A cap 36 having screw threads 37 formed thereon is engageable with a threaded collar 38 formed at the top of the body 32, the cap 36 having a hose 39 extending therethrough and connected up to a source of high pressure actuating fluid 40 located exteriorly of the device 10. The source 40 can be any suitable source for actuating the pistons 12,14 and preferably comprises a pneumatic compressor. High pressure fluid from line 39 is fed through line 41 to the top of cylinder 15 above piston 14, and fluid passes through line 42 to the top of cylinder 13 above piston 12.

The means 16 for supplying actuating pressurized fluid to the second piston 14 and then to the first piston 12 may include any suitable conventional structure such as a diaphragm mechanism, valves, or the like. One form that the means 16 may take is shown most clearly in FIGS. 1 and 2, and includes first and second triggers 44 and 45 respectively, operatively associated with the first handle 33, the first trigger 44 for effecting supply of fluid to the first piston 12, and the second trigger 45 for effecting supply of actuating fluid to the second piston 14. A pin 46 may extend from first trigger 44 to second trigger 45 for making abutting engagement with the second trigger 45 to provide means for operatively connecting the triggers 45,44 so that the first trigger 44 cannot be actuated to supply fluid to the first piston 12 until the second trigger 45 has been actuated to supply fluid to the second piston 14. Other suitable connections or pneumatic or electrical controls may be provided to ensure that once trigger 45 has been pulled, actuating fluid cannot again be supplied to outer piston 14 until trigger 44 is pulled.

As shown in FIG. 2, trigger 44 may be connected to a first valve means 48, and trigger 45 connected to a second valve means 49, the first valve means 48 for either venting line 42 to atmosphere (the normal position into which it is spring biased) or connecting line 39 to line 42, and the second valve means 49 either venting line 41 to atomsphere (the normal position) or connecting line 41 to line 39.

Various safety mechanisms may be provided for preventing supply of fluid to the piston 12,14, in the FIG. 1 embodiment, such as means 26 and 28. The safety means 26 may include a microswitch 50 that is depressed only when the blow shield 52 of the device 10 is pressed into solid contact with a surface through which the fasteners 20 are to be driven. The blow shield 52 preferably is formed of flexible material, and has a ring actuating portion 53 thereof spring biased by coil spring 54 or the like into a downward position. When the blow shield 52 is pressed against the workpiece, the ring 53 moves against the biasing spring 54 and depresses microswitch 50. Microswitch 50 in turn may either control a solenoid actuated valve in line 39, or may control a solenoid 55 (see FIG. 2) for moving a locking pin 56 out of locking enagement with trigger 45 with microswitch 50 is actuated.

The safety mechanism 28 is associated with second handle 34, and may comprise a wide variety of means that require positive actuation by the operator on handle 34 before fluid may be supplied from line 39 to the pistons 12,14. A preferred form of the safety mechanism 28 is illustrated in FIGS. 1 and 2. The handle 34 is mounted by bushings 58 for rotation with respect to body portion 32, and a shaft 59 is connected to handle 34 for rotation therewith against the bias of torsion spring 60 or the like. At one end of the shaft 59 a cam 62 is provided, a cam follower-lin rod 63 being spring biased into engagement with the cam surface of cam 62. Rotation of cam 62 imparts a linear movement to the rod 63, which in turn may control a valve in line 39 that allows passage of fluid from source 40 to lines 41 and 42, or—as shown in FIG. 2—may control movement of a blocking arm out of blocking engagement with the triggers 44,45. As shown in FIG. 2, the end of spring pressed reciprocal rod 63 opposite its point of engagement with cam 62 is pivotally mounted at 65 to a disc 66 that is rotatable about an axis perpendicular to the axis about which triggers 44 and 45 are pivoted. A blocking element 67 is also pivotally mounted to the disc 66, so that upon movement of rod 63 in direction B (see FIG. 2) as a result of rotation of cam 62, the element 67 will be pivoted out of locking engagement with the triggers 44 and 45, allowing actuation thereof.

Figure 4:
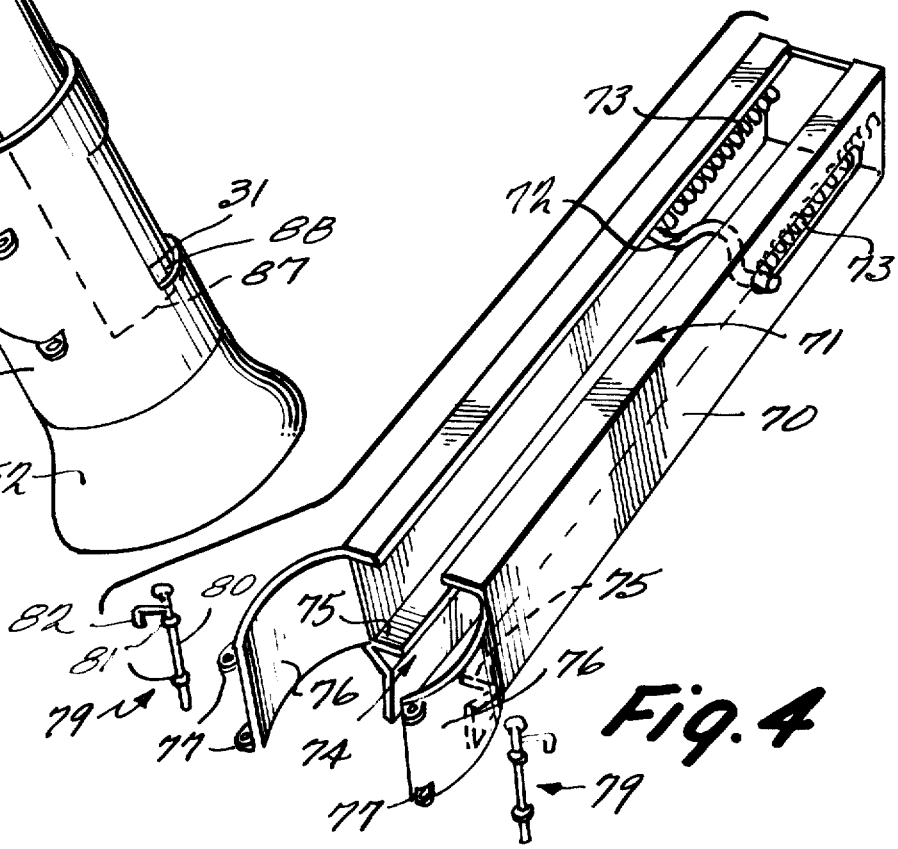
FIG. 4 is a perspective view of an exemplary magazine utilizable in the device of FIG. 1.

The magazine 24 for feeding fasteners 20 automatically one at a time into the receiving chamber 18 of device 10, is shown most clearly in FIGS. 1 and 4. The magazine 24 includes a body portion 70 with a generally open top 71, and a rod 72 biased by compression spring 73 to push fasteners 20 contained within the magazine 24 out of the open front end 74 thereof. A desirable arrangement for the magazine 24 includes longitudinally extending support ridges 75 formed therein for engaging and vertically supporting selected portions of the fasteners 20 so that fasteners 20 slide with rod 72 under the bias of spring 73 out of the open front 74 of the magazine 24, through opening 31, past the load gate 30 (when open) and into the chamber 18. The magazine 24 may be connected to the body portion 32 of the device 10 by arcuate portion 76 which partially wrap around the exterior of the body portion 32 in the vicinity of opening 31. Eyelets 77 are formed at the termination of either arcuate member 76, and the eyelets cooperate with similar eyelets 78 formed on the body 32 on either side of opening 31. Quick release spring clips 79 are provided to hold the eyelets 77,78 together, the shank 80 of each clip 79—with detent formations 81 thereon—passing through cooperating eyelets 77,78 to hold them together. Arm 82 may be manually engaged for effecting movement of the shank 80 out of engagement with the eyelets 77,78. After release of the spring clip 79, the magazine 24 may either be replaced or reloaded.

Figure 7:
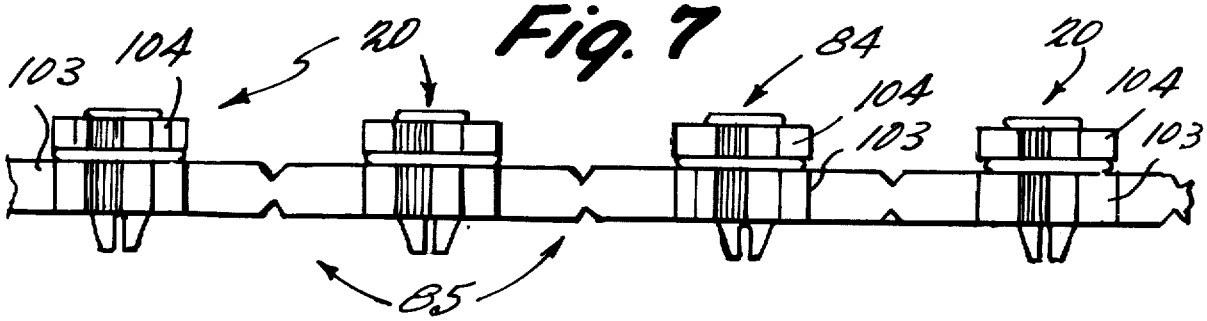
FIG. 7 is a side schematic showing an assembly of fasteners utilizable according to the present invention.

An assembly of two-piece fasteners 20 that are operatively connected together for automatic feeding thereof by magazine 24 is illustrated in FIG. 7. The assembly 84 of FIG. 7 includes frangible connector means 85 for operatively connecting consecutive fasteners 20 together. The connector means 85 may include a chain of plastic components having grooves 86 formed therein at midpoints between consecutive fasteners 20. When the fasteners 20 are fed into the chamber 18, and the gate means 30 is moved to block the passageway 31—sealing off the chamber 18—edge means 87 on the gate 30 cooperate with edge means 88 of the body 32 to fracture the connectors 85 along grooves 86. The connectors 85 are formed of frangible plastic or the like so that upon firing of the fasteners 20 out of barrel 23, the connectors 25 disintegrate upon impact with the work surface.

The gate 30 may be raised to passage-31 unblocking position, or lowered to passage-31 blocking position, by any suitable manual or powered means. One such suitable arrangement is shown schematically in FIGS. 1 and 3, and includes a manually operated lever 90 pivotally mounted to first handle 33. The lever 90 is connected by link 91 to reciprocal plate 92. Flanges 93 may be formed on plate 92 for cooperating with cooperating grooves (not shown) within the interior of body 32 for guiding reciprocal movement of the plate 92 in direction A, and opposite to direction A. One or more rods 94 operatively connect the plate 92 to loading gate 30 so that reciprocal movement of the plate 92 results in reciprocal movement of gate 30. Plate 92 preferably is biased to the closed position (FIGS. 1 and 3) by suitable biasing means, such as a plurality of tension springs 95, one disposed around each rod 94 and operatively connected to plate 92 and a support 96 stationary with respect to body 32. If desired, a microswitch 97 or the like may be provided for actuation by lever 90, it being necessary that lever 90 be in the down position—and thus loading gate 30 closed—before it is depressed, depression of the actuator for the microswitch 97 being necessary before a circuit can be completed through solenoid 55 for moving blocking pin 56 out of locking engagement with trigger 45. Additionally, a latching means may be provided for latching the leading edge 87 of gate 30 in closed position.

The gate 30 may be replaced by a stationary structure 30', as shown in FIG. 11, with movable wall portions 150 provided for allowing passage of fastener assemblied 20 into operative position with the pistons 12,14.

The firing barrel 23 (shown most clearly in FIGS. 1 and 9) preferably is readily replaceable, a key 98 being formed exterior thereof for cooperation with a corresponding keyway 99 formed in the bottom portion of body 32, with releasable fastening means provided between body 32 and key 98. Additionally, the barrel 23 also preferably is rifled—see rifling grooves 100—so that an angular velocity component is imparted to at least one of the fastener components 21,22 to ensure that fastener components are driven through. Alternatively, guide grooves may be provided in the barrel 23 for guiding straight line movement of the fastener component.

When riflings 100 are provided in the bore 23, and rifling is desired, means must be provided associated with fasteners 20 for engaging the barrel riflings 100 so that angular velocity is imparted to the fasteners during axial movement thereof. Such riflings engaging means may comprise at least one frangible link 102 associated with each fastener 20. For instance—as shown most clearly in FIGS. 5-7—two frangible links 103,104 are provided, having surface means 106 formed thereon for engaging riflings 100. The link 104 cooperating with inner fastener component 21 will preferably not have surface means 106 disposed around the entire periphery thereof; otherwise it might interfere with the movement of piston 14 impacting on outer component 22. The impacting surface of outer piston 14 may be shaped so that it does not engage surface means 106 of link 104. The links 103,104 are constructed of suitable frangible plastic or the like so that they disintegrate upon impact on the surface through which the fastener 20 associated therewith is driven. When links 103 are provided, they may be directly connected to connectors 85 between consecutive fasteners 20.

A powered impacting device according to the preferred embodiment of the present invention is shown in FIGS. 10*a* through 10*c*. The device includes a massive first inner piston 12', and a second outer piston 14' concentric with the first piston 12' and forming a cylinder wall for guiding movement of the first piston 12' (which is relatively movable with respect to piston 14'). The means for supplying actuating fluid 16' need only utilize one valve mechanism 49', and one trigger 45' to drive the two pistons, as opposed to the two valves and trigger mechanisms which are necessary in the FIG. 1 embodiment. Biasing means, such as spring 120, are provided between the pistons 12', 14', exerting a force in direction F for biasing the piston 12' to a particular relative initial position with respect to the second piston 14', and means 18', such as the cylinder 122 having an end face 124 and opening 125 therein, are provided for receipt of the two-piece fastener 20 so that the outer component of the fastener is driven by the piston 14', and the inner component is driven by the piston 12'. The first piston 12' is massive enough so that upon termination of movement of the second piston 14' under the influence of actuating fluid, the first piston will continue movement in the direction A against the bias of the biasing means 120 with sufficient force to drive the inner component of the fastener into desired final operative position with respect to the outer component (see FIG. 12*d*). Such relative movement between the pistons 12', 14' is shown in FIG. 10*c*.

The second piston 14' has an end face 127 which is adapted to abut the end face 124 of cylinder 122 to prevent further relative movement between the piston 14' and the cylinder 122, and means are provided for venting gas between the first and second pistons upon relative movement thereof, and from between the cylinder 122 and piston 14' upon relative movement therebetween. Venting of gas between the pistons 12', 14' may be provided by an annular groove 128 formed on the interior of the face 124, and at least one bleed hole 129 in the face 127 cooperating with the groove 128 and allowing passage of gas from between the pistons 12',14' to the groove 128. Additionally, biasing means are provided for biasing the second piston 14' with respect to the cylinder 122 so that the end faces 124,127 do not normally abut (see FIG. 10*a*) and so that a two-piece fastener may be received in the opening 125 of the cylinder 122. The biasing means may comprise a spring, or as shown in FIG. 10*a*, means 131 for supplying low pressure gas to the area between the faces 127,124. Where air biasing is used, the same pressure source 40 as for driving the pistons may be utilized, a line 132 leading therefrom, and a suitable pressure reducer 133 being disposed in line 132, as well as a check valve 134 allowing flow of gas in passageway 132 only toward the cylinder 122, a line 135 ultimately leading into the area between the faces 127, 124 from the line 132. Additionally, additional means may be provided for venting the area between the faces 127,124 upon relative movement therebetween, such as a vent passageway 137 with a check valve 138 therein for allowing passage of the gas only from passageway 135 to passageway 137, not from exterior of the device into the passageway 135. The springs of the valves 134,138 are selected so that the valve 138 normally does not operate under the influence of the biasing pressure normally supplied through line 132, but only operates upon a pressure gauge, such as exists when the faces 127,124 are moved rapidly toward each other.

The actuating fluid supplying means 16' according to the FIG. 10*a* embodiment, preferably comprises a third piston 140 in abutting engagement with the second piston 14' and abutting first piston 12' in the initial position (FIG. 10*a*), the piston 12' being relatively axially movable with respect to the third piston 140. Piston 140 is movable in cylinder 141, and pressurized fluid is supplied thereto from pressure source 40 through passageway 39 and valve 49' and passageway 41' upon depression of the trigger 45'. The third piston 140 includes a vent passageway 143 therein for allowing gas to flow from between the first and third pistons 12', 140 upon relative axial movement therebetween.

The operation of the embodiment of FIG. 10*a* is shown schematically in FIGS. 10*a* through 10*c*. In the initial position, the components assume the relationship illustrated in FIG. 10. After depression of the trigger 45', third piston 140 is driven which in turn drives the pistons 12',14' together toward the fastener 20 located in opening 125 of cylinder 122. The second piston 14' is driven to the position illustrated in FIG. 10*b*, wherein the end face 127 thereof abuts the end face 124 of the cylinder 122. In this position, the tubular extension 145 of the end face 127 has driven the outer component of the fastener 20 through the work, and the gas between the faces 127,124 has been vented through vent passageway 137. In the position shown in FIG. 10*b*, no further movement of the pistons 14',140 takes place in the direction A, but since the piston 12' is massive and since only the biasing force of the spring 120 is exerting any force preventing movement thereof in direction A, the piston 12' continues moving until the end face 147 thereof abuts the end face 127 of the second piston 14', the gas from between the pistons 12', 14' being vented into the deep annular groove 128. At this position, which is shown in FIG. 10*c*, the cylindrical extension 146 of piston 12' has driven the inner component of the fastener 20 so that it is in proper position with respect to the outer component, fastening the work pieces together, as shown in FIG. 12*d*. Once the faces 147,127 abut, the piston 12' automatically returns under the bias of spring 120 to the position shown in FIG. 10*b*, gas between pistons 140 and 12' being vented through passageway 143.

Many other modifications of the FIG. 10 embodiment are also possible. For instance, the second piston 14' may be rigidly attached to the third piston 140, although for ease of assembly and repair, this normally is not advisable. Additionally, the cylinder 122 may be constructed so that it has movable wall portions, much like the assembly shown in FIG. 11, for automatic feeding of fasteners into place in opening 125 for engagement by the piston portions 145,146.

Figure 5:
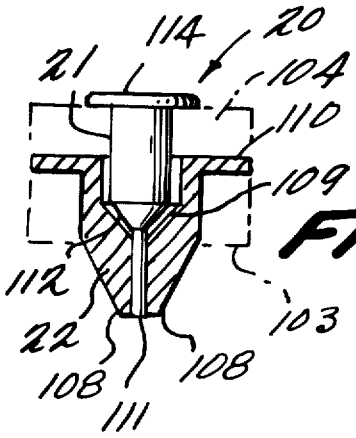
FIG. 5 is a cross-sectional view of an exemplary two-piece fastener according to the present invention.
Figure 6:
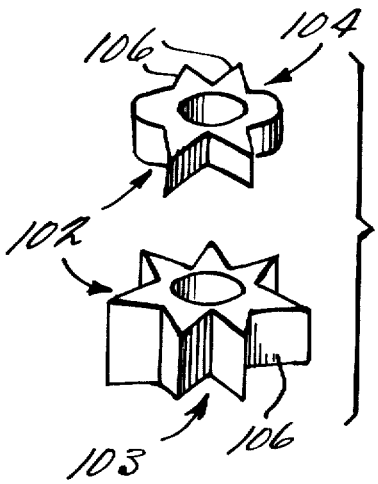
FIG. 6 is a perspective view of exemplary frangible plastic links utilizable with the fastener of FIG. 5.
Figures 8A, 8B, 8C:
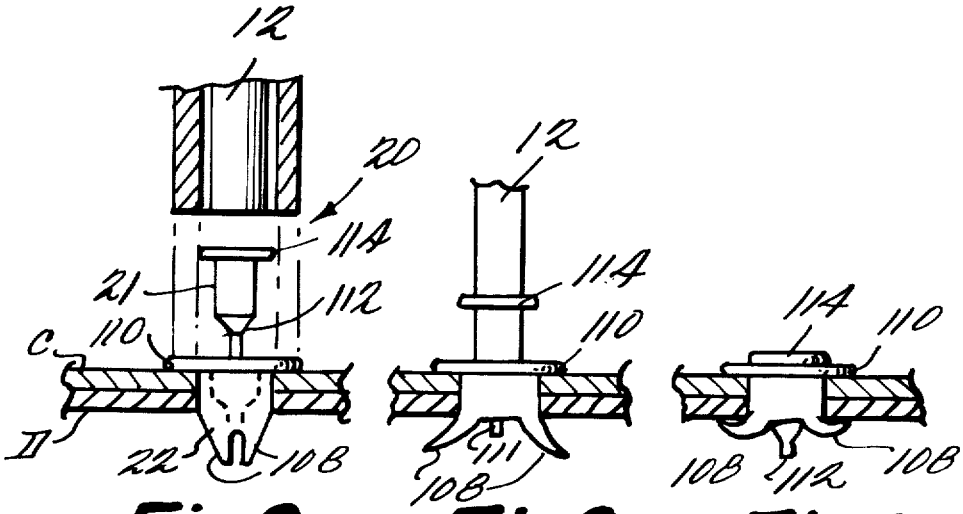
FIGS. 8A through 8C are schematic showings of successive steps for utilizing the fastener of FIG. 5 to fasten workpieces together.

A variety of two-piece fasteners may be utilized as the fasteners 20,20' according to the present invention, such as those illustrated in FIGS. 5 and 8, and FIGS. 12*a* to 12*d*. In the embodiment of FIGS. 5 and 8, the fastener 20 has an outer component 22 formed as a generally tubular member having a hollow tip at least two grooves 115 extending along the body of component 22 from the tip so that at least two distinct tip portions 108 are provided, forming a penetrating point; and component 22 also has cam-engaging interior portions 109 thereof. A ring-like head 110 is provided for engaging the top of two material sheets to be fastened together. The inner component 21 comprises a cylindrical member having a pointed tip portion 111, and cam surface means 112 for engaging the cam engaging interior portions 109 of a cooperating outer component 22 for camming the distinct tip portions 108 radially outwardly with respect to the inner component 21. Use of fasteners 20 according to the invention to fasten together two worksheets (i.e. two pieces of sheet metal) C and D is shown in FIGS. 8*a*–8*c*. In FIG. 8*a*, the outer piston 14 has impacted against the head 110 of the outer fastener 22 and has driven the tip portions 108 of the outer component 22 through both the sheets C and D. The head 114 of the inner component 21 has not as yet been impacted by the inner position 12. FIG. 8*b* shows the fastener inner component 21 midway through the driving thereof through the sheets C,D by the inner piston 12, the cam portions 112 of component 21 engaging the cam engaging portions 109 of outer component 22 to begin to move the tip portions 108 radially outwardly. FIG. 8*c* shows the fastener after complete penetration of the sheets C,D by the inner component 21, the head 114 of inner component 21 solidly abutting the head 110 of the outer component 22, and the camming portions 112 of component 21 having completely radially outwardly moved the tip portions 108 of component 22 into holding engagement with the bottom of sheet D, sheets C and D thus being sandwiched together between head 110 and tips 108.

While the utilization of the fasteners according to the invention has been described with respect to the fastening of two pieces of sheet metal together, it is understood that suitable fasteners 20 may be constructed for fastening together a wide variety of compositions of workpieces, such as two or more pieces of wood, two or more pieces of other sheet material, or the like. The fastener 20 components 21,22 preferably are constructed of relatively hard metal, or other strong malleable material. The fasteners 20' illustrated in FIGS. 12*a* through 12*d* are similar 5o those illustrated in FIGS. 5 and 8, only are of even simpler construction, being inexpensive yet effective in fastening workpieces together. The fasteners in FIG. 12 include an outer metal generally tubular component 22' having a hollow tip and at least two groups 115 extending along the body of the component 22' from the tip so that at least two distinct tip portions 108 are provided at the end of the outer component, the two tip portions sloping toward each other so that the outer component tip is pointed. A head portion 110' is provided at the opposite end of the component 22' as the tip portions 108' thereof, and the cam engaging interior portions 109' are provided simply as interior surface portions of the hollow tip of the component 22'. A generally cylindrical metal inner component 21' having a substantially pointed distal tip 111' is provided, the cam surface means 112' thereof for engaging the outer component portions 109' merely provided by surface portions forming the distal tip 111' of the inner component 21'. When the components 22',21' are driven relative to each other according to the invention, they assume the position shown in FIG. 12*d*, fastening any number of workpieces C,D,E together. The grooves 115 are constructed so that they extend a sufficient distance along the body of the outer component 22' so that the outer component 22' will penetrate the desired thickness of material to be fastened together without splitting, but so the tip portions 108' may be moved radially outwardly by the inner component 21' a sufficient distance to effect fastening of the material together (as shown in FIG. 12*d*). The dimensions of the grooves 115 (as also perhaps the number thereof) may be adjusted depending upon the type and thickness of the material to be fastened together.

In embodiments where the pieces to be fastened together (i.e. sheets C,D, and E) are duct work pieces, it may be desirable to ensure that no air can pass past the fastener components from inside the duct to the exterior thereof. This may be accomplished by providing a deformable material 117 (see FIG. 12*c*) disposed between the first and second components 21',22' for providing air tight sealing therebetween upon completion of relative movement therebetween. Alternatively, the inner component 21' may be provided with a head (such as head 114 in the FIGS. 5 and 8 embodiment) for sealing with the outer component 22' is substantially air tight engagement.

Thus, it will be seen that according to the present invention, a powered impacting device which effects automatic sequential driving of two pistons for driving both the inner and outer components of two-piece fasteners through work sheets to be fastened together without interruption in the driving operation has been provided, as well as simple, easy to construct, inexpensive two-piece fasteners that result in excellent fastening of a wide variety of materials and material thicknesses together.

While the invention has been herein shown and described in what is presently conceived to be the most preferred and practical embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A powered impacting device comprising a massive first, inner, piston;

a second, outer, piston, concentric with said first piston and forming a cylinder wall for guiding movement of said first piston, said first piston being relatively movable with respect to said second piston;

means for supplying actuating fluid so that said pistons move in a given axial direction;

biasing means between said first and second pistons exerting a force in a direction opposite said given axial direction for biasing said first piston to a particular relative position with respect to said second piston;

means for receipt of a self-piercing two-piece fastener, having concentric inner and outer components, in operative relationship with said pistons so that said outer component is driven by said second piston to pierce a workpiece, and said inner component is driven by said first piston to effect locking of said outer component with said workpiece, said means comprising a cylinder for guiding movement of said second piston in the axial direction; said cylinder having an end face for operatively stopping axial movement of said second piston;

means for venting gas from between said first and second pistons upon relative movement between said first and second pistons, and from between said cylinder and said second piston upon relative movement therebetween; and said first piston being massive enough so that upon termination of movement of said second piston under the influence of the actuating fluid said first piston will continue movement in said axial given direction against the bias of said biasing means with sufficient force to drive said inner component into desired final operative position with respect to said outer component.

2. A device as recited in claim 1 wherein said biasing means comprises a coil spring.

3. A device as recited in claim 1 wherein said gas venting means comprise an annular groove formed in said cylinder end face, and at least one bleed hole formed in said second piston end face cooperating with said annular groove when said second piston abuts said cylinder, said bleed hole allowing passage of gas from between said pistons to said groove.

4. A device as recited in claim 1 further comprising means for biasing said second piston with respect to said cylinder so that said end faces thereof normally do not abut.

5. A device as recited in claim 4 wherein said biasing means acting between said second piston and cylinder comprises means for supplying low pressure gas to the area between said second piston and cylinder end faces.

6. A device as recited in claim 5 wherein said means for venting gas between said second piston and cylinder comprises a vent passage leading from the area therebetween with a check valve therein for allowing passage of gas through said vent passageway only out from between said second piston and cylinder 7. A device as recited in claim 1 further comprising a third piston in abutting engagement with said second piston, and for abutting said first piston, and means for supplying high pressure fluid to said third piston for driving said first and second pistons, said first piston being relatively axially movable with respect to said third piston.

8. A device as recited in claim 7 wherein said third piston includes a vent passageway therein for allowing gas to flow between and from between said first and third pistons upon relative axial movement therebetween.

9. A powered impacting device comprising a massive first, inner, piston; a second, outer piston concentric with said first piston and forming a cylinder wall for guiding movement of said first piston, said first piston being relatively movable with respect to said second piston; means for supplying actuating fluid so that said pistons move in a given axial direction; biasing means for biasing said first piston in a direction opposite said given axial direction to a particular relative position with respect to said second piston; said first piston being massive enough so that upon termination of movement of said second piston under the influence of the actuating fluid said first piston will continue movement in said axial direction against the bias of said biasing means until positively stopped; a cylinder for guiding movement of said second piston in the axial direction; means for venting gas from between said cylinder and said second piston upon relative movement therebetween; and means for venting gas from between said first and second pistons upon relative movement therebetween.

10. A device as recited in claim 9 wherein said gas venting means for venting gas between said second piston and said cylinder comprises an annular groove formed in said cylinder end face; and wherein said means for venting gas from between said first and second pistons comprises at least one bleed hole formed in the end face of said second piston, said bleed hole allowing passage of gas from between said pistons to said groove.

11. A device as recited in claim 10 wherein said cylinder comprises means for receipt of a self-piercing two-piece fastener having concentric inner and outer components in operative relationship with said pistons so that said outer component is driven by said second piston to pierce a workpiece, and said inner component is driven by said first piston to effect locking of said outer component with said workpiece.

12. A device as recited in claim 9 wherein said means for venting gas from between said first and second pistons comprises at least one bleed hole formed in an end face of said second piston.

13. A device as recited in claim 12 wherein said means for venting gas from between said first and second pistons further comprises a groove formed in an end face of said cylinder, said at least one bleed hole formed in the end face of said second piston allowing passage of gas from between said pistons to said groove.

14. A device as recited in claim 9 wherein said first piston includes a circular cylindrical extension and wherein said second piston has an end face which includes a concentric opening therein for receipt of said first piston cylindrical extension, and wherein said second piston further includes a tubular extension extending outwardly from said second piston surrounding said concentric opening, said first piston cylindrical extension being long enough to pass completely through said second piston tubular extension upon relative movement between said first and second piston.

15. A device as recited in claim 14 wherein said means for venting gas from between said first and second pistons comprises at least one bleed hole formed in the end face of said second piston and spaced from said concentric opening in said second piston end face.

16. A device as recited in claim 15 wherein said means for venting gas from between said first and second pistons further comprises a groove formed in an end face of said cylinder, said at least one bleed hole allowing passage of gas from between said pistons to said groove.

17. A powered impacting device comprising a massive first, inner, pistons, and having a cylindrical extension concentric therewith and extending from one end thereof;

a second, outer piston concentric with said first piston and forming a cylinder wall for guiding movement of said first piston, said first piston being relatively movable with respect to said second piston, said second piston including a concentric opening in an end face thereof receiving said first piston cylindrical extension, and having a tubular extension concentric with said opening and extending therefrom;

means for supplying actuating fluid so that said pistons move in a given axial direction;

said first piston being massive enough, and said cylindrical extension thereof being long enough, so that upon termination of movement of said second piston under the influence of the actuating fluid said first piston will continue movement in said axial direction until positively stopped, and said cylindrical extension will extend completely through said tubular extension of said second piston; and means for venting gas from between said first and second pistons upon relative movement therebetween, said means including at least one bleed opening formed in said second piston end face and spaced from said concentric opening.

18. A device as recited in claim 17 wherein said first piston further comprises a bore formed therein concentric with said cylindrical extension, and wherein said device further comprises spring means disposed in said bore and surrounding said cylindrical extension and abutting said first piston and said end face of said second piston for biasing said first piston in a direction opposite said given axial direction to a particular relative position with respect to said second piston.

19. A device as recited in claim 17 further comprising a stop member for stopping movement of said second piston under the influence of said actuating fluid, said stop member having an opening formed therein for receiving said second piston tubular extension, and said second piston tubular extension being long enough to extend completely through said stop member opening when said stop member stops said second piston.

20. A device as recited in claim 19 wherein said stop member includes a groove formed therein for operative communication with said at least one bleed hole formed in said second piston end face, so that gas from between said pistons may pass through said bleed hole into said groove.

* * * * *